US005957283A

United States Patent [19]

Reichert

[11] Patent Number: 5,957,283

[45] Date of Patent: Sep. 28, 1999

[54] INDIVIDUAL SKI PROTECTOR AND METHODS FOR ITS USE

[75] Inventor: Jeffrey H. Reichert, Torrington, Wyo.

[73] Assignee: Gear Reichert, Ltd., Torrington, Wyo.

[21] Appl. No.: 08/884,911

[22] Filed: Jun. 30, 1997

Related U.S. Application Data

[63] Continuation of application No. 08/552,300, Nov. 2, 1995, abandoned.

[51] Int. Cl.[6] ..... A45C 11/00; A63C 11/00

[52] U.S. Cl. ..... 206/315.1; 206/811; 224/917

[58] Field of Search ..... 280/814, 815; 224/917; 294/147; 206/315.1, 811

[56] References Cited

U.S. PATENT DOCUMENTS

| | | | |
|---|---|---|---|
| 2,180,686 | 11/1939 | Lorinovich . | |
| 2,250,388 | 7/1941 | Mickelberg . | |
| 3,336,961 | 8/1967 | Welsh . | |
| 3,851,689 | 12/1974 | Kohls . | |
| 3,909,031 | 9/1975 | Schmaedeke et al. . | |
| 3,948,302 | 4/1976 | Kohls . | |
| 4,191,233 | 3/1980 | McKay . | |
| 4,644,986 | 2/1987 | Fusaro . | |
| 4,715,416 | 12/1987 | Horne . | |
| 4,746,159 | 5/1988 | Webb et al. . | |
| 5,012,921 | 5/1991 | Becker | 206/315.1 |
| 5,022,678 | 6/1991 | Mayfield . | |
| 5,207,323 | 5/1993 | McConnell . | |

*Primary Examiner*—Jacob K. Ackun

*Attorney, Agent, or Firm*—Townsend and Townsend and Crew

[57] ABSTRACT

The invention provides an exemplary ski protector comprising an elongate sleeve body having a top side, a bottom side, a back end, a front end, and a midsection between the front and back ends. The sleeve body flares at the midsection so that the sleeve body is adapted to closely conform to the shape of a ski when placed therein. A fastener extends at least part way between the back end and the front end and provides an access way into the sleeve body when unfastened. A handle is attached to the sleeve body at the midsection such that the sleeve body may be balanced about the handle when the ski is within the sleeve body. A pair of resilient straps are attached to the bottom side of the sleeve body and are adapted to hold a second ski against the bottom side of the sleeve body.

27 Claims, 3 Drawing Sheets

INDIVIDUAL SKI PROTECTOR AND METHODS FOR ITS USE

This is a Continuation of application Ser. No. 08/552,300, filed Nov. 2, 1995, now abandoned, the disclosure of which is incorporated by reference.

BACKGROUND OF THE INVENTION

This invention relates generally to the field of ski equipment. More particularly, the invention relates to protective ski covers which may be placed around individual skis.

Snow skis are highly refined pieces of sporting equipment which require careful maintenance and protection. For example, snow skis often need to be waxed, the edges sharpened, and the bindings kept free of dirt and grit. Due to the nature of snow skiing, skis are often stored for long periods of time without being used. When used, the skis are often carried or transported over long distances and often through poor weather. The manner in which the skis are stored, carried and transported can contribute to the overall condition and working order of the skis. For instance, if skis are stored in damp conditions, some of the ski parts may corrode or rust. As another example, skis are often hand carried or transported (such as in an airplane or automobile) by placing two or more skis in a single bag. Such a method for transporting the skis can be undesirable in that the skis can bang together and damage each other. Such a problem is heightened if poles or other ski accessories are also placed within the bag. Such bags can also be both bulky and expensive.

One common way to transport skis is on top of an automobile, such as when placed on a ski rack or other carrier. When transported in this manner, the skis are usually attached to a ski rack without a protective cover so that the skis will be able to properly fit within the rack. However, when left unprotected the skis are susceptible to road grit and other abrasive elements which might affect how the bindings release. Road grit can also damage the edges and dull fresh wax. Also, prolonged exposure to moisture can damage the skis.

When transporting skis, it is often desirable to transport the skis with other equipment, such as poles, gloves, goggles, and the like. However, transporting such equipment can be cumbersome to the skier, particularly when trying to carry these items all at the same time.

It is therefore an object of the present invention to overcome or greatly reduce these and other problems when transporting, carrying or storing skis. In particular, it would be desirable to provide systems, methods and apparatus which would allow skis to be easily and conveniently stored, carried or transported. Such systems, methods and apparatus should provide protection for the skis by repelling moisture and other grit which may damage the skis. The systems, methods and apparatus should further provide for the individual protection of each ski so that one ski will not damage another ski or other equipment when being stored, carried or transported. The apparatus should further be lightweight and form-fitting so that the skis can be used with conventional ski racks and will not be bulky or inconvenient to carry, particularly by hand. The systems and apparatus should further be inexpensive and facilitate carrying of other ski accessories, such as poles, gloves, goggles and the like.

Other objects and advantages of the invention will become apparent and obvious from a study of the following description and the accompanying drawings.

SUMMARY OF THE INVENTION

The invention provides systems, methods and apparatus for protecting individual skis, particularly when storing, carrying or transporting the skis. In one exemplary embodiment, the invention provides a ski protector having an elongate sleeve body with a top side, a bottom side, a back end, a front end, and a midsection between the front and back ends. The sleeve body is constructed of a substantially waterproof fabric. The sleeve body flares at the midsection and is adapted to closely conform to the shape of the ski when placed therein. In particular, the flared midsection allows the sleeve body to receive the ski binding, with the remainder of the sleeve body conforming to the shape of the ski.

The ski protector further includes a fastener extending at least part way between the back end and the front end, with the fastener providing an access way into an interior of the sleeve body when unfastened. A handle is provided and is attached to the sleeve body at the midsection such that the sleeve body (when holding a ski) may be balanced when holding the sleeve body by the handle. A pair of resilient straps is further provided. The resilient straps are attached to the bottom side of the sleeve body, with one strap being near the back end and the other strap being near the front end. In this manner, the resilient straps may be employed to hold a second ski (which will also preferably be held within a ski protector) against the bottom side of the sleeve body. Hence, by providing the resilient straps, a pair of skis may be secured together with their bottoms facing each other so that the skis may easily be transported by grasping the handle.

In one particular aspect, a second pair of resilient straps are provided and are attached to the midsection. The second pair of resilient straps enable a ski pole (or poles) to be secured to the sleeve body at the midsection. The resilient straps on the bottom side and the resilient straps on the midsection preferably each comprise a continuous strap of an elastic material having opposing ends that are attached to the sleeve body. In this way, a ski pole or another ski can easily be attached to the sleeve body by sliding the ski pole or ski through the straps. In further aspect, the second pair of straps on the midsection are preferably orthogonal to the handle so that the ski poles will be generally parallel to the skis (and the handle) when attached to the sleeve body.

In another particular aspect, the handle is an elongate piece of a nylon fabric and is attached to the sleeve body between the top side and the bottom side. The sleeve body preferably comprises a substantially waterproof nylon material that will protect the skis from being exposed to moisture. The tip of the sleeve body is preferably V-shaped so that it will conform to the ski tip. In another aspect, a ring is disposed about the handle so that an attachment member of a ski accessory may be attached to the handle. For example, gloves, goggles, sunglasses and the like may be clipped to the ring. In still a further aspect, the fastener preferably comprises a zipper.

The invention further provides an exemplary ski protection system. The ski protection system includes a pair of skis, with each ski comprising a ski body having a tip and a back end and a binding attached to the ski body. A pair of ski protectors are provided, with each protector having an elongate sleeve body with a top side, a bottom side, a back end, a front end, and a midsection between the front and back ends. Each protector further includes a fastener extending at least part way between the back end and the front end and provides an access into the interior of the sleeve body when unfastened. Each protector is sized and shaped such that each ski may be received into the interior of a corresponding one of the protectors, with the sleeve body generally conforming to the shape of the ski body and the binding. At least one of the protectors further includes a pair of resilient straps attached to the bottom side of the sleeve body. One of the straps is near the back end and the other strap is near the front end so that one of the skis may be attached to the protector by sliding the ski beneath the straps. At least one of the protectors further includes a handle attached to the midsection so that the combined protectors (having the skis) may be balanced about the handle when transporting the skis.

Such a ski protection system is advantageous in that each of the skis may be placed into a corresponding protector and the protectors attached to each other by the resilient straps. The skis will be attached together such that their bottoms face each other. Since the sleeve bodies closely conform to the shape of the ski body and binding, the ski protection system will not be bulky nor heavy. Further, the skis may be transported or carried by merely grasping the handle to lift the skis (which will be balanced about the handle).

The invention provides an exemplary method for transporting skis. According to the method, a ski protector is provided having an elongate sleeve body with a top side, a bottom side, a back end, a front end, and a midsection between the front and back ends. The sleeve body flares at the midsection and is constructed of a substantially waterproof fabric. A fastener extends at least part way between the back end and the front end, with the fastener providing an access way into the sleeve body when unfastened. A handle is attached to the sleeve body at the midsection. A pair of resilient straps are further provided and are attached to the bottom side of the sleeve body, with one strap near the back end and the other strap near the front end. With such a configuration, the ski is placed into the interior of the ski body through the access way and the fastener is fastened. The handle is then grasped and the ski protector is lifted, with the sleeve body being balanced about the handle. Preferably, the sleeve body will closely conform to the shape of the ski when the ski is placed therein and the fastener is fastened.

In another aspect, the method includes the step of providing a second ski protector and placing a second ski within the second protector. The back end of the second protector is then slid through the resilient strap near the back end of the first protector and the front end of the second protector is slid through the resilient strap near the front end of the first protector. In this manner, the skis will be placed adjacent each other and may be carried together by grasping and lifting the handle. Preferably, a second pair of resilient straps are attached to the midsection of one of the protectors and a ski pole is secured within the second pair of straps. In still a further aspect, a ring is preferably provided around the handle so that various ski accessory equipment may be attached to the ring. In still a further aspect, the ski protector and ski are placed on an automobile ski rack.

DETAILED DESCRIPTION OF THE SPECIFIC EMBODIMENTS

Figure 1:
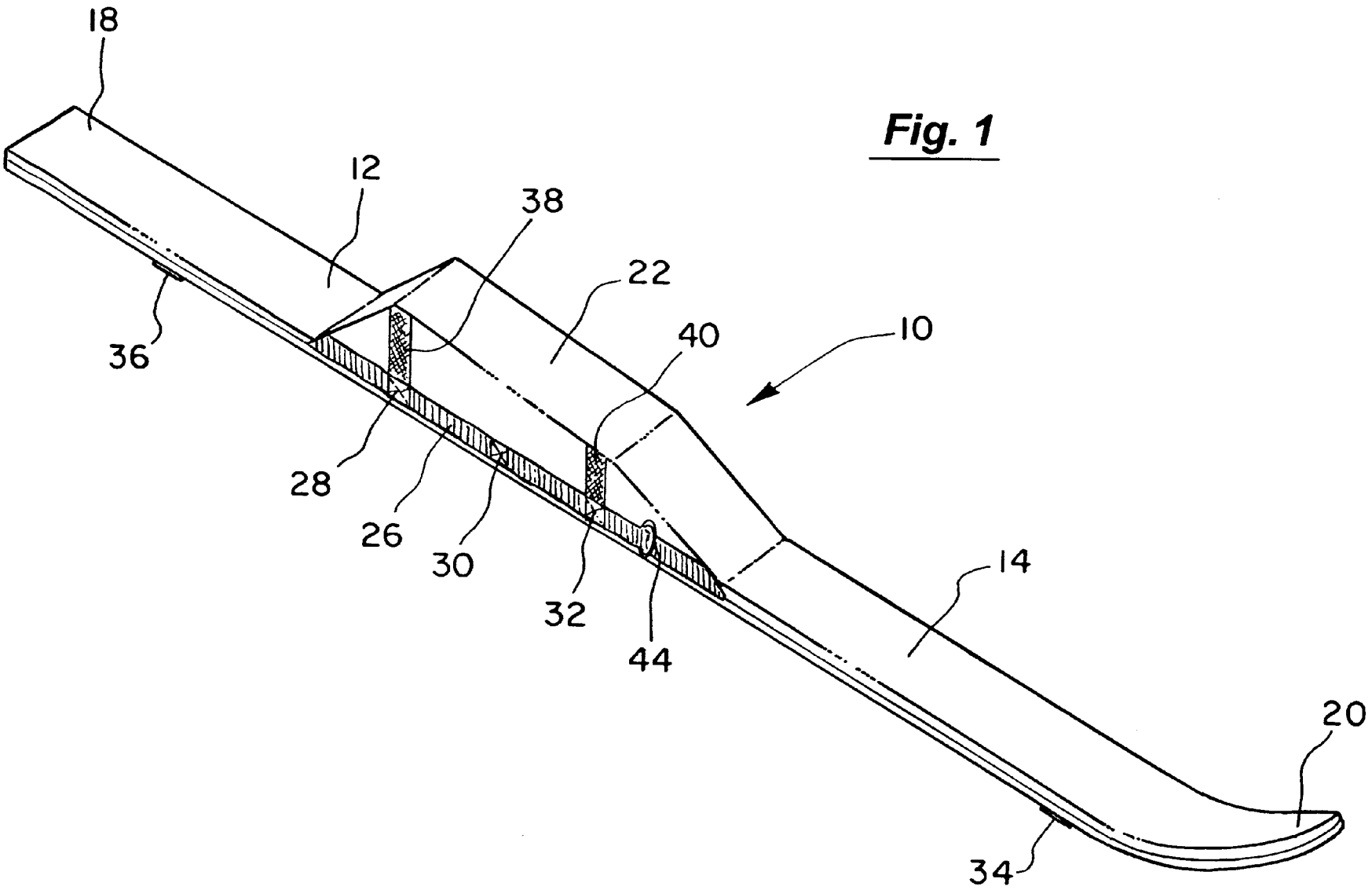
FIG. 1 is a perspective view of an exemplary embodiment of a ski protector according to the present invention.

Referring now to the figures, an exemplary embodiment of a ski protector 10 will be described. As best shown in FIGS. 1–4, the ski protector 10 includes an elongate sleeve body 12 having a top side 14, a bottom side 16 (see FIG. 4), a back end 18, a front end 20, and a midsection 22 between the front end 20 and back end 18. The sleeve body 12 is preferably constructed of a substantially waterproof fabric to protect the ski from exposure to moisture, grit and dirt. Particularly preferable waterproof fabrics include waterproof nylon fabrics. Preferably, the waterproof fabric will also be weatherproof, i.e. will be resistant to ultraviolet rays.

Figure 2:
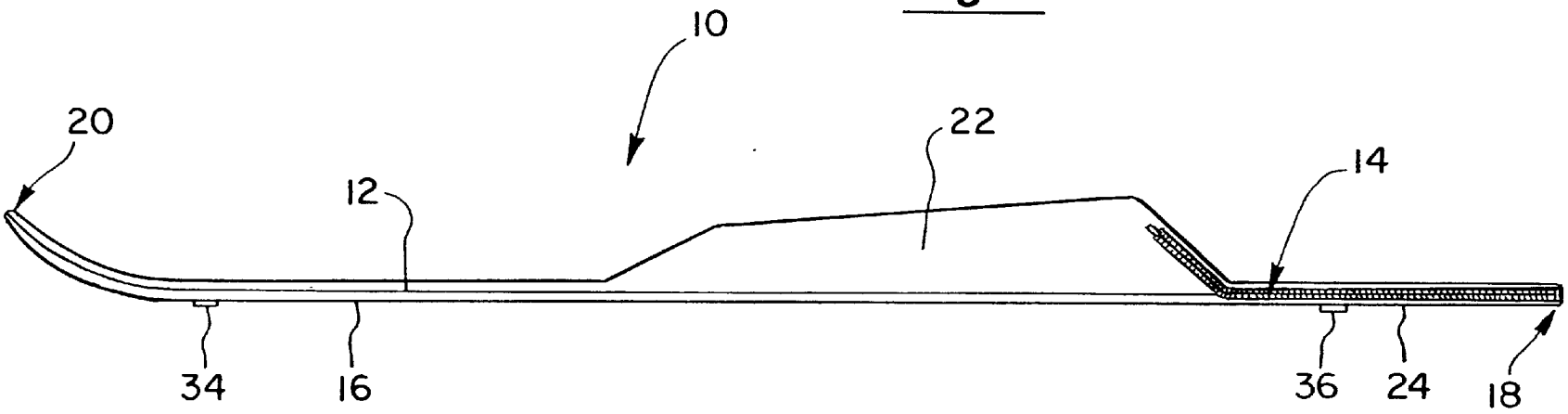
FIG. 2 is a side view of a left side of the ski protector of FIG. 1.

Extending between the back end 18 and the midsection 22 is a zipper 24 (see FIG. 2). When unzipped, the zipper 24 provides an access way into an interior of the sleeve body so that a ski may be inserted into the sleeve body when unzipped. Although shown extending between the back end 18 and the midsection 22, the zipper 24 may extend any length along the sleeve body 12. For example, the zipper 24 may extend the entire length between the back and front ends 18, 20 or may alternatively be positioned at any location therebetween.

The sleeve body 12 is shaped and sized so that it will closely conform to the shape of the ski. For example, the front end 20 has a V-shape so as to conform to the shape of the ski tip and the back end 18 is squared to match the back of the ski. The midsection 22 is flared radially outward from a longitudinal axis extending between the back and front ends 18, 20 and is sized and shaped to receive a ski binding. In this manner, the sleeve body 12 will closely conform to the shape of the ski (including the binding) when placed in the sleeve body. This reduces bulk so that the combined protector and ski may be more easily carried, transported and stored. For example, such a construction of the sleeve body is particularly advantageous when carrying the skis on an automobile ski rack. Since the sleeve body 12 closely conforms to the shape of the ski, the ski may easily be placed within the racks of a conventional automobile ski carrier. The waterproof nature of the sleeve body also protects the ski from dirt or grit which may dull the ski wax or affect the bindings.

Another advantage of constructing the sleeve body of a nylon material is that such a material is relatively inexpensive and lightweight. A further advantage is that the protector is designed to hold a single ski, thus preventing a pair of skis from damaging each other (or other equipment) when transported or carried together.

The ski protectors 10 can be constructed to match virtually any size of ski. Each ski protector 10 will preferably be slightly longer and wider than the ski to be held therein so that the protector 10 will closely conform to the size and shape of the ski when placed therein.

The ski protector 10 further includes a handle 26 that is attached to the midsection 22 (see FIG. 1). The handle 26 is generally parallel to the longitudinal axis of the sleeve body and is attached to the midsection 22 such that when a ski is placed within the protector 10 and lifted by the handle 26, the combined protector and ski will be balanced about the handle 26. Preferably, the handle 26 will comprise an elongate piece of nylon fabric that is sewn to the sleeve body 12, such as at various points 28, 30 and 32 (see FIG. 5).

Figure 5:
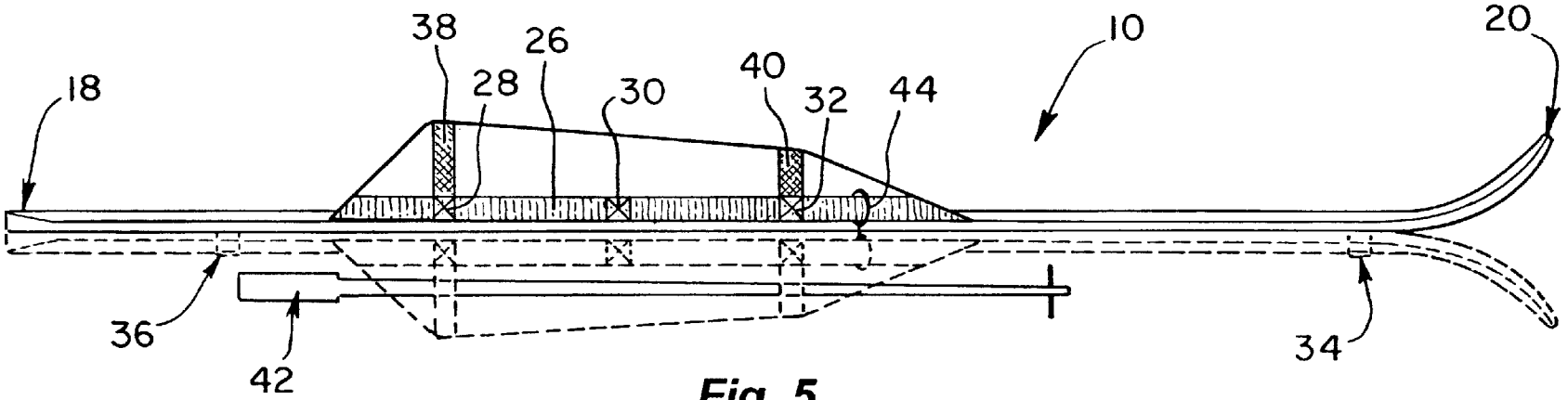
FIG. 5 is a side view of a right side of the ski protector of FIG. 1 shown attached to a corresponding ski protector according to the present invention.
Figure 4:
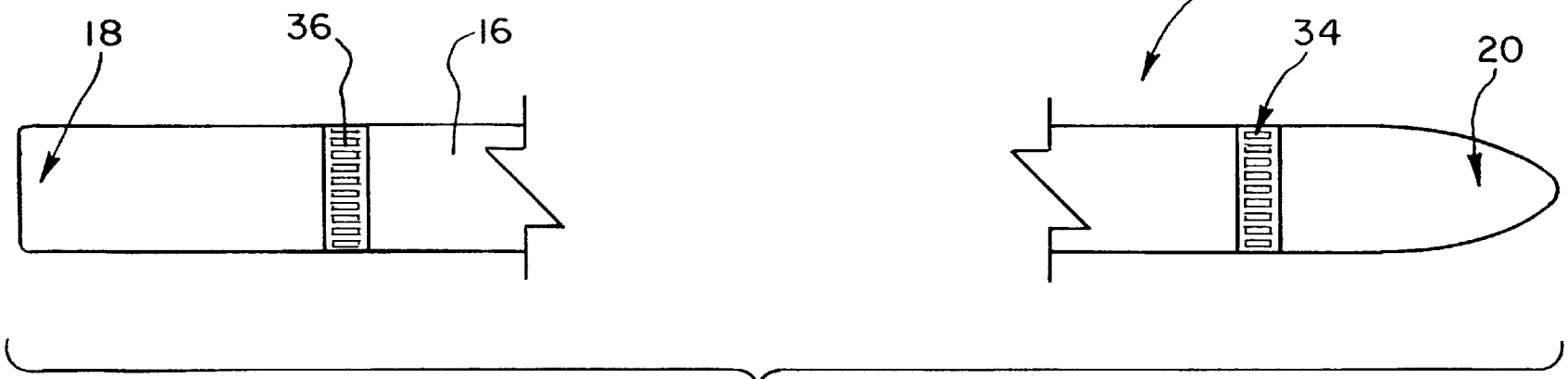
FIG. 4 is a partial bottom view of the ski protector of FIG. 1.

As best shown in FIGS. 2 and 4, the bottom side 16 of the sleeve body 12 is provided with a pair of resilient straps 34, 36. Strap 34 is placed near the front end 20, and strap 36 is placed near the back end 18. Alternatively, one or more straps may be provided on the bottom side 16. Also, the location of the straps may be varied to facilitate attachment of another ski. The resilient straps 34, 36 are preferably constructed of an elastic material, such as a nylon web which is sewn at both ends to the sleeve body 12. In this way, two ski protectors having skis therein may be attached together at their respective bottom sides by sliding the front end of one of the ski protectors through strap 34 and by sliding the back end of the ski protector through strap 36 to place the skis adjacent each other as illustrated in FIG. 5. The resilient straps 34, 36 will preferably have sufficient elasticity so that the skis will be held snugly together when attached at their bottom sides. The handle 26 is preferably placed between the top side 14 and bottom side 16 so that when two skis are attached together as illustrated in FIG. 5, the combined skis may be carried or transported by merely grasping the handle 26 and lifting the skis.

As best shown in FIGS. 1 and 5, the ski protector 10 may further be provided with a second pair of resilient straps 38, 40 which are attached to the midsection 22 orthogonal to the handle 26. In this manner a ski pole 42 or pair of poles may be attached to the ski protector 10 generally parallel to the longitudinal axis as shown in FIG. 5 merely by sliding the pole 42 beneath the straps 38, 40.

Figure 3:
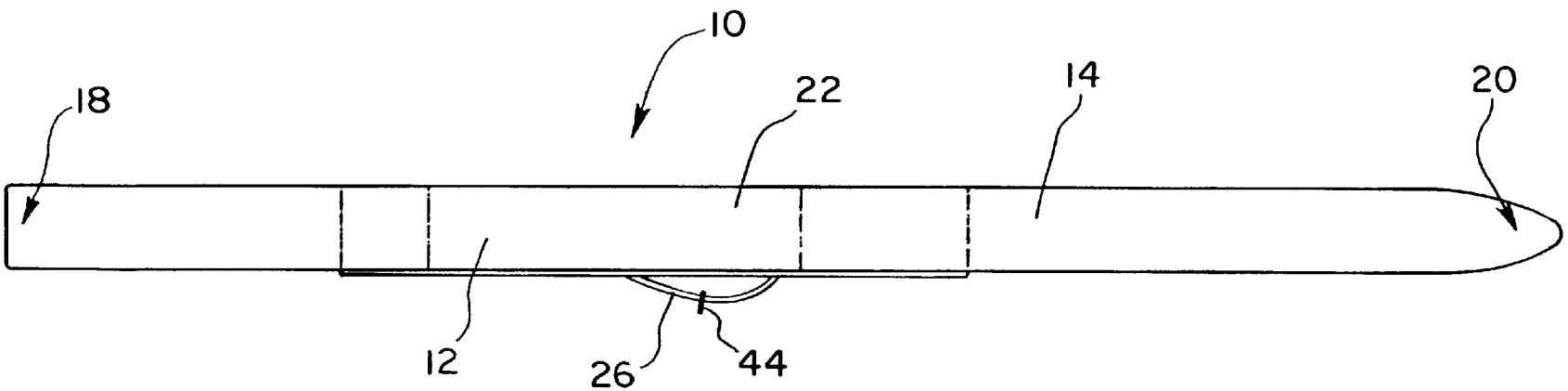
FIG. 3 is a top view of the ski protector of FIG. 1.

As shown in FIGS. 1, 3 and 5, a ring 44 may optionally be attached about the handle 26. The ring 42 may be constructed of a metal, a plastic, a fabric, or the like. The ring 44 is provided so that various ski accessories can be attached to the ski protector. For example, ski gloves, goggles, sunglasses, cases, and the like may be attached to the ring 44 and carried along with the ski protector 10.

The invention has now been described in considerable detail for purposes of understanding. However, alternative uses for the invention will occur to those skilled in the art. Therefore, the above description should not be taken as limiting the scope of the invention. Instead, the scope of the invention should be determined chiefly with reference to the appended claims, along with a full scope of equivalents to which those claims are entitled.

What is claimed is:

1. A ski protector, comprising:

an elongate sleeve body having a top side, a bottom side, a back end, a front end which is adapted to be placed over a tip of a ski, and a midsection between the front and back ends, wherein the body is continuous from the front end to the back end, wherein the sleeve body flares at the midsection so that the sleeve body is adapted to closely conform the shape of the ski when placed therein, and wherein the sleeve body is constructed of a substantially waterproof fabric;

a fastener extending in an axial line from the back end to the midsection and then extending upwardly along the midsection, the fastener providing an access way into the sleeve body when unfastened;

a handle attached to the sleeve body at the midsection between the top side and the bottom side such that the handle is tightly received against the sleeve body and such that the sleeve body may be balanced when holding the sleeve body by the handle when the ski is within the sleeve body, with the ski being positioned on its side such that a bottom of the ski is vertically oriented; and a pair of straps attached to the sleeve body, wherein one strap is near the back end, and the other strap is near the front end, and wherein the straps are adapted to hold a second ski against the bottom side of the sleeve body.

2. The ski protector of claim 1, further comprising a second pair of straps attached to the midsection, wherein the second pair of straps are adapted to secure a ski pole to sleeve body at the midsection.

3. The ski protector of claim 2, wherein the straps on the midsection each comprise a continuous strap of an elastic material having opposing ends, and wherein the ends of each strap are attached to the sleeve body.

4. The ski protector of claim 2, wherein the second pair of straps on the midsection are attached to the sleeve body generally orthogonal to the handle.

5. The ski protector of claim 1, wherein the handle is an elongate piece of nylon fabric.

6. The ski protector of claim 1, wherein the waterproof fabric of the sleeve body comprises a nylon material.

7. The ski protector of claim 1, wherein the tip of the sleeve body is V-shaped.

8. The ski protector of claim 1, further comprising a ring disposed around handle, the ring being adapted to receive an attachment member of a ski accessory.

9. The ski protector of claim 1, wherein the fastener comprises a zipper.

10. A ski protection system, comprising:

a pair of skis, each ski comprising a ski body with a tip and a back and a binding attached to the ski body;

a pair of ski protectors, each protector comprising an elongate sleeve body having a top side, a bottom side, a back end, a front end, and a midsection between the front and back ends, wherein each sleeve body is continuous from the front end to the back end, wherein each protector further comprises a fastener extending between the back end and the front end, the fastener providing access to an interior of the sleeve body when unfastened;

wherein each protector is sized and shaped such that each ski may be received into the interior of a corresponding one of the protectors, with the sleeve body conforming to the shape of the ski body and binding and with a tip of each ski being received into the front end of each protector;

wherein at least one of the protectors includes a pair of straps attached to the sleeve body, with one strap near the back end and the other strap near the front end such that one of the skis may be attached to the protector by positioning the straps around the ski; and wherein at least one of the protectors includes a handle attached to the midsection between the top side and the bottom side such that the handle is tightly received against the sleeve body and such that the pair of protectors may be balanced when holding the handle while the skis are within the protectors and the protectors are attached together, with the skis being positioned on their sides such the bottoms of the skis are vertically oriented.

11. The ski protection system of claim 10, wherein each ski is held within a corresponding protector, and wherein the protectors are attached to each other by the straps, with the bottoms of the protectors adjacent each other.

12. The ski protection system of claim 10, further comprising a second pair of straps attached to the midsection at of least one of the protectors, wherein the second pair of straps are adapted to secure a ski pole to sleeve body at the midsection.

13. The ski protection system of claim 12, wherein the straps on the midsection each comprise a continuous strap of an elastic material having opposing ends, and wherein the ends of each strap are attached to the sleeve body.

14. The ski protection system of claim 12, wherein the second pair of straps on the midsection are attached to the sleeve body generally orthogonal to the handle.

15. The ski protection system of claim 10, wherein the handle is an elongate piece of nylon fabric.

16. The ski protection system of claim 10, wherein the waterproof fabric of each sleeve body comprises a nylon material.

17. The ski protection system of claim 10, wherein the tip of each sleeve body is V-shaped.

18. The ski protection system of claim 10, further comprising a ring disposed around at least one of the handles, the ring being adapted to receive an attachment member of a ski accessory.

19. The ski protector of claim 10, wherein each fastener comprises a zipper.

20. A method for transporting skis, the method comprising:

providing a ski protector comprising an elongate sleeve body having a top side, a bottom side, a back end, a front end, and a midsection between the front and back ends, wherein the body is continuous from the front end to the back end, wherein the sleeve body flares at the midsection, and wherein the sleeve body is constructed of a substantially waterproof fabric; a fastener extending in an axial line from the back end to the midsection and then extending upwardly along the midsection, the fastener providing an access way into the sleeve body when unfastened; a handle attached to the sleeve body at the midsection between the top side and the bottom side such that the handle is tightly received against the sleeve body; and a pair of straps attached to the sleeve body, wherein one strap is near the back end, and the other strap is near the front end;

placing the ski into the interior of the sleeve body through the access way and adjusting the position of the ski until a tip of the ski is within the front end;

grasping the handle with the hand and lifting the ski protector by the handle such that the sleeve body is balanced about the handle so as to be generally horizontally oriented, with the ski being positioned on its side such that a bottom of the ski is vertically oriented.

21. The method of claim 20, further comprising fastening the fastener with the ski within the protector such that the sleeve body closely conforms the shape of a ski.

22. The method of claim 20, further comprising:

providing a second ski protector;

placing a second ski within the second protector; and aligning the front end of the second protector with the front end of the first protector and fastening the straps around the second protector.

23. The method of claim 20, further comprising providing a second pair of straps that are attached to the midsection of the first protector, and securing a ski pole within the second pair of straps.

24. The method of claim 20, further comprising providing a ring around handle, and attaching a ski accessory to the ring.

25. The method of claim 20, further comprising placing the ski protector and ski on an automobile ski rack.

26. A method for transporting skis, the method comprising:

providing a pair of ski protectors, each comprising an elongate sleeve body having a top side, a bottom side, a back end, a front end, and a midsection between the front and back ends, wherein the sleeve body flares at the midsection; a fastener extending in an axial line from the back end to the midsection and then extending upwardly along the midsection, the fastener providing an access way into the sleeve body when unfastened; a handle attached to the sleeve body at the midsection between the top side and the bottom side such that the handle is tightly received against the sleeve body; and a pair of straps attached to the sleeve body, wherein one strap is near the back end, and the other strap is near the front end;

placing a ski into the interior of each of the sleeve bodies through their access ways until a tip of the skis is enclosed by the front ends of the sleeve bodies;

strapping the skis together with the straps such the bottom sides of the sleeve bodies are adjacent each other;

grasping both of the handles with the hand and lifting the ski protectors by the handles such that the sleeve body is balanced about the handle so as to be generally horizontally oriented, with the skis being positioned on their sides such that the bottoms of the skis are vertically oriented.

27. A method as in claim 26, wherein each sleeve body is continuous from the front end to the back end.

* * * * *